US009105213B2

(12) United States Patent
Kwak

(10) Patent No.: US 9,105,213 B2
(45) Date of Patent: Aug. 11, 2015

(54) ORGANIC LIGHT EMITTING DIODE DISPLAY AND METHOD OF DRIVING THE SAME

(71) Applicant: LG Display Co., Ltd., Seoul (KR)

(72) Inventor: Sang Hyeon Kwak, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 55 days.

(21) Appl. No.: 13/676,239

(22) Filed: Nov. 14, 2012

(65) Prior Publication Data

US 2014/0049531 A1 Feb. 20, 2014

(30) Foreign Application Priority Data

Aug. 17, 2012 (KR) ..... 10-2012-0090192

(51) Int. Cl.
*G09G 3/30* (2006.01)
*G09G 1/00* (2006.01)
*G09G 3/32* (2006.01)

(52) U.S. Cl.
CPC ..... *G09G 1/005* (2013.01); *G09G 3/3225* (2013.01); *G09G 2230/00* (2013.01); *G09G 2300/0852* (2013.01); *G09G 2300/0861* (2013.01); *G09G 2320/045* (2013.01)

(58) Field of Classification Search
CPC ..... G09G 3/30–3/3291
USPC ..... 345/76
See application file for complete search history.

(56) References Cited

U.S. PATENT DOCUMENTS

| | | | | |
|---|---|---|---|---|
| 8,446,403 | B2 * | 5/2013 | Tsuchi et al. | 345/212 |
| 2004/0196239 | A1 | 10/2004 | Kwon | |
| 2005/0264493 | A1 * | 12/2005 | Shin | 345/76 |
| 2006/0139259 | A1 * | 6/2006 | Choi et al. | 345/76 |
| 2007/0024543 | A1 | 2/2007 | Chung et al. | |
| 2009/0309816 | A1 * | 12/2009 | Choi | 345/76 |
| 2011/0193850 | A1 * | 8/2011 | Chung et al. | 345/212 |

FOREIGN PATENT DOCUMENTS

| | | | |
|---|---|---|---|
| CN | 1534568 | A | 10/2004 |
| KR | 10-2005-0109699 | | 11/2005 |
| KR | 10-2007-0015829 | A | 2/2007 |

OTHER PUBLICATIONS

First Notification of Office Action dated Feb. 16, 2015 from The State Intellectual Property Office of China in counterpart Chinese application No. 2012104833640.

* cited by examiner

*Primary Examiner* — Roy Rabindranath
(74) *Attorney, Agent, or Firm* — Morgan, Lewis & Bockius LLP

(57) ABSTRACT

An OLED display device is provided. The OLED display device may include a first capacitor connected between a data line and a first node, a first transistor connected to the first node and a second node, an OLED connected between a low-level source voltage terminal and a third node, a second transistor connected to the second and third nodes, a driving transistor, and a second capacitor. The driving transistor may have a gate connected to the first node, a drain connected to the second node, and a source connected to a high-level source voltage terminal. One end of the second capacitor may receive a control signal, and the other end of the second capacitor may be connected to the first node.

16 Claims, 12 Drawing Sheets

ORGANIC LIGHT EMITTING DIODE DISPLAY AND METHOD OF DRIVING THE SAME

CROSS-REFERENCE TO RELATED APPLICATIONS

This application claims the benefit of the Korean Patent Application No. 10-2012-0090192 filed on Aug. 17, 2012, which is hereby incorporated by reference as if fully set forth herein.

BACKGROUND

1. Field of the Disclosure

Embodiments of the present invention relate to a display device, and more particularly, to an organic light emitting diode (OLED) display device and a method of driving the same.

2. Discussion of the Related Art

With the advancement of an information-oriented society, various requirements for display field are increasing, and thus, research is being conducted on various flat panel display devices that are thin, light, and have low power consumption. For example, the flat panel display devices are often categorized into liquid crystal display (LCD) devices, plasma display panel (PDP) devices, OLED display devices, etc.

Particularly, some of the OLED display devices that are being actively studied recently apply data voltage (Vdata) having various levels to respective pixels in order to display different grayscale levels, thereby realizing an image.

To this end, each of a plurality of pixels may include one or more capacitors, an OLED, and a driving transistor that are current control elements. Particularly, a current flowing in the OLED may be controlled by the driving transistor, and the threshold voltage deviation of the driving transistor and the amount of a current flowing in the OLED may be changed by various parameters, causing non-uniformity in screen luminance.

However, a threshold voltage deviation of the driving transistor can occur because the characteristic of the driving transistor changes due to a variable manufacturing process variable used for the driving transistor. To overcome this limitation, each pixel may generally include a compensation circuit that includes a plurality of transistors and capacitors for compensating for the deviation of the threshold voltage.

Recently, as consumers' requirements for high definition has increased, a high-resolution OLED display device has been demanded. To this end, it is generally necessary to integrate more pixels into an unit area for higher resolution, and thus, it is typically required to reduce the numbers of transistors, capacitors, and lines included in the compensation circuit that compensates for the deviation of a threshold voltage.

Moreover, image quality is usually degraded because the amount of a current flowing in the OLED is not uniform due to various parameters, and thus, it is typically necessary to compensate for the change in the amount of a current due to a parameter such as a source voltage.

SUMMARY

Accordingly, embodiments of the present invention are directed to an OLED display device and a method of driving the same that substantially obviate one or more problems due to limitations and disadvantages of the related art.

An aspect of embodiments of the present invention is directed to provide an OLED display device that can compensate for the deviation of a threshold voltage and is suitable for high resolution, and a method of driving the same.

Additional advantages and features of embodiments of the invention will be set forth in part in the description which follows and in part will become apparent to those having ordinary skill in the art upon examination of the following or may be learned from practice of embodiments of the invention. The objectives and other advantages of embodiments of the invention may be realized and attained by the structure particularly pointed out in the written description and claims hereof as well as the appended drawings.

To achieve these and other advantages and in accordance with the purpose of embodiments of the invention, as embodied and broadly described herein, there is provided an OLED display device that may include a first capacitor connected between a data line and a first node, and receiving a data voltage or a reference voltage that is supplied through the data line; a first transistor connected to the first node and a second node, and connecting the first and second nodes according to a scan signal; an OLED connected between a low-level source voltage terminal and a third node; a second transistor connected to the second and third nodes, and controlling light emission of the OLED; a driving transistor having a gate connected to the first node, a drain connected to the second node, and a source connected to a high-level source voltage terminal; and a second capacitor, one end of the second capacitor receiving a control signal, and the other end of the second capacitor being connected to the first node.

In another aspect of an embodiment of the present invention, there is provided a method of driving an OLED display device, including first and second transistors, a driving transistor, first and second capacitors, and an OLED, that may include performing an operation in which while the first and second transistors are turned on, a first node corresponding to a gate of the driving transistor is connected to a second node corresponding to a drain of the driving transistor, a third node corresponding to an anode of the OLED is connected to the second node, and a control signal is applied to as a low-level voltage to one end of the second capacitor connected to the first node; performing an operation in which while the first transistor is turned on and the second transistor is turned off, an nth data voltage is applied to one end of the first capacitor, a voltage of the first node corresponding to the other end of the first capacitor increases to a sum of a high-level source voltage and a threshold voltage of the driving transistor, and the control signal is applied to as a high-level voltage to the one end of the second capacitor; performing an operation in which while the first and second transistors are turned off, data voltages after the nth data voltage are continuously applied to one end of the first capacitor, and the control signal is changed from the high-level voltage to the low-level voltage; and performing an operation in which while the first transistor is turned off and the second transistor is turned on, a reference voltage is applied to the one end of the first capacitor, and the OLED emits light.

It is to be understood that both the foregoing general description and the following detailed description of embodiments of the present invention are exemplary and explanatory and are intended to provide further explanation of the invention as claimed.

BRIEF DESCRIPTION OF THE DRAWINGS

The accompanying drawings, which are included to provide a further understanding of embodiments of the invention and are incorporated in and constitute a part of this application, illustrate embodiments of the invention and together with the description serve to explain the principle of embodiments of the invention. In the drawings.

DETAILED DESCRIPTION

Hereinafter, embodiments of the present invention will be described in detail with reference to the accompanying drawings.

Figure 1:
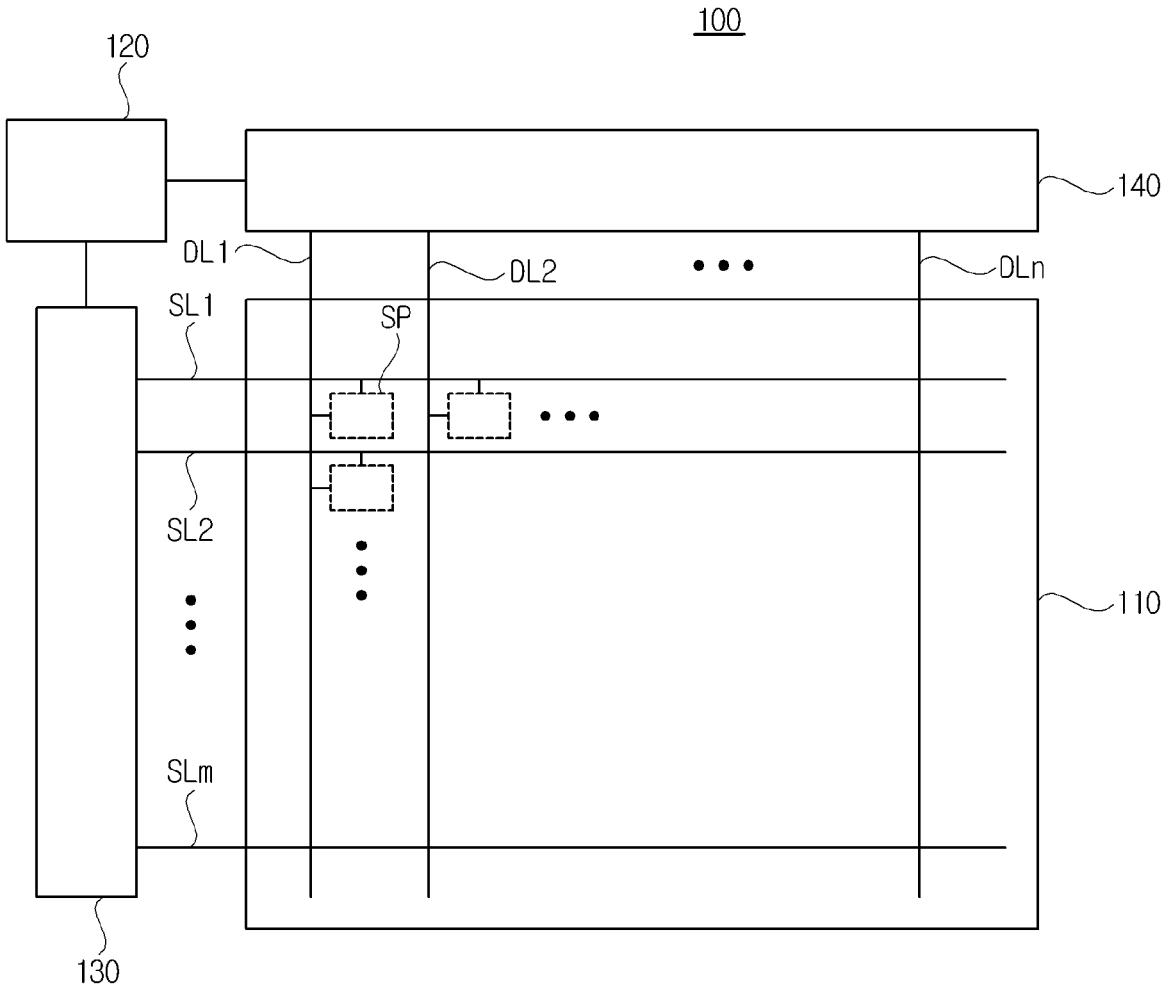
FIG. 1 is a diagram schematically illustrating an exemplary configuration of an OLED display device according to embodiments of the present invention.

FIG. 1 is a diagram schematically illustrating a configuration of an OLED display device according to embodiments of the present invention.

As illustrated in FIG. 1, an OLED display device 100 according to embodiments of the present invention may include a panel 110, a timing controller 120, a scan driver 130, and a data driver 140.

The panel 110 may include a plurality of sub-pixels SP that are arranged in a matrix type. The sub-pixels SP included in the panel 110 may emit light according to respective scan signals which are supplied through a plurality of scan lines SL1 to SLm from the scan driver 120 and respective data signals that are supplied through a plurality of data lines DL1 to DLn from the data driver 130. To this end, one sub-pixel may include an OLED, and a plurality of transistors and capacitors for driving the OLED. The detailed configuration of each of the sub-pixels SP will be described in detail with reference to FIG. 2.

The timing controller 120 may receive a vertical sync signal Vsync, a horizontal sync signal Hsync, a data enable signal DE, a clock signal CLK, and video signals from the outside. Also, the timing controller 120 may align external input video signals to digital image data RGB in units of a frame.

For example, the timing controller 120 controls the operational timing of each of the scan driver 130 and the data driver 140 with a timing signal that includes the vertical sync signal Vsync, the horizontal sync signal Hsync, the data enable signal DE, and the clock signal CLK. To this end, the timing controller 120 generates a gate control signal GCS for controlling the operational timing of the scan driver 130 and a data control signal DCS for controlling the operational timing of the data driver 140.

The scan driver 120 may generate a scan signal "Scan" that enables the operations of transistors included in each of the sub-pixels SP in the panel 110, according to the gate control signal GCS supplied from the timing controller 120, and may supply the scan signal "Scan" to the panel 110 through the scan lines SL. Also, the scan driver 120 may generate an emission control signal Em as a kind of a scan signal, and may supply the emission control signal Em to the panel 100 through a plurality of emission control lines (not shown).

The data driver 130 may generate data signals with the digital image data RGB and the data control signal DCS that are supplied from the timing controller 120, and may supply the generated data signals to the panel 110 through the respective data lines DL.

Hereinafter, the detailed configuration of each sub-pixel will be described in detail with reference to FIGS. 1 and 2.

Figure 2:
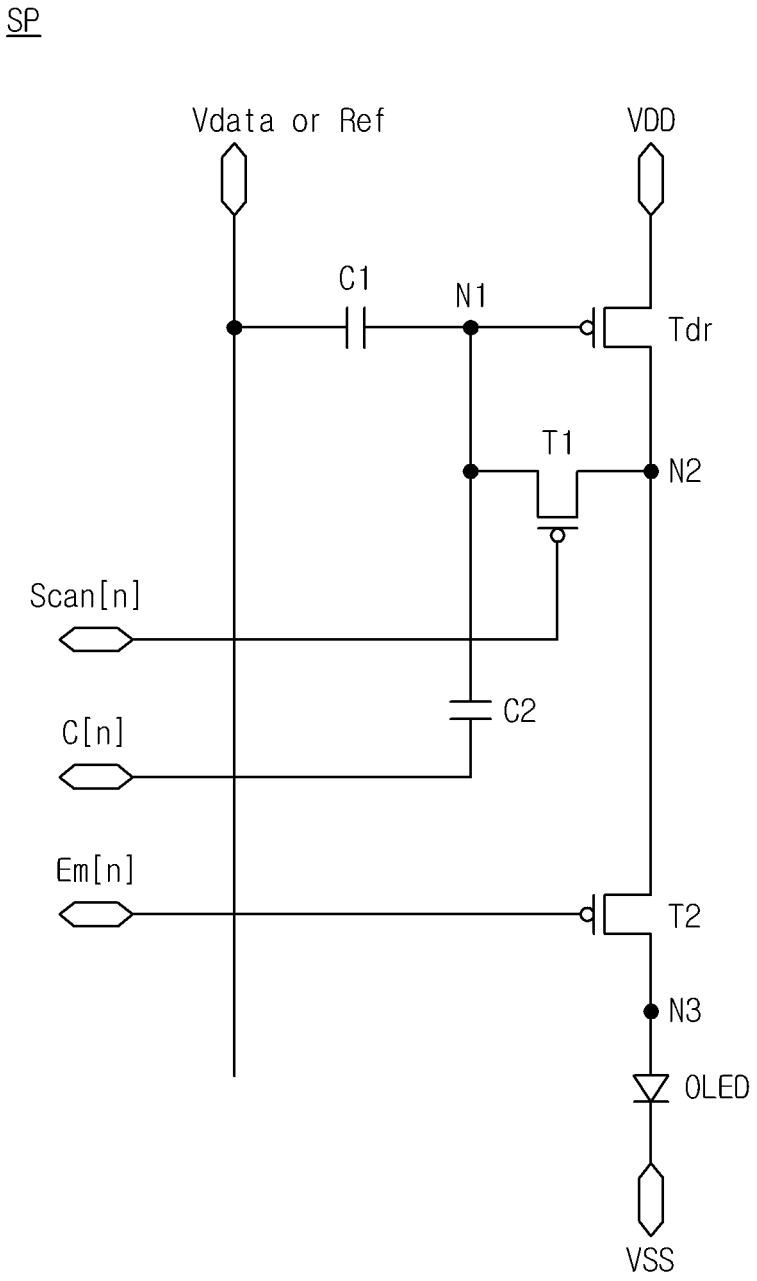
FIG. 2 is a diagram schematically illustrating an equivalent circuit of a sub-pixel of FIG. 1.

FIG. 2 is a diagram schematically illustrating an exemplary equivalent circuit of a sub-pixel of FIG. 1.

As illustrated in FIG. 2, each sub-pixel SP may include first and second transistors T1 and T2, a driving transistor Tdr, first and second capacitors C1 and C2, and an organic light-emitting diode (OLED).

The first and second transistors T1 and T2 and the driving transistor Tdr, as illustrated in FIG. 2, may be PMOS transistors, but are not limited thereto. As another example, an NMOS transistor may be applied thereto, in which case a voltage for turning on the PMOS transistor has a polarity opposite to that of a voltage for turning on the NMOS transistor.

With regard to FIG. 2, first, a data voltage Vdata or a reference voltage Ref is applied to one end of the first capacitor C1, and the other end of the first capacitor C1 is connected to a first node N1 corresponding to a gate of the driving transistor Tdr.

For example, the data voltage Vdata or the reference voltage Ref is applied to the one end of the first capacitor C1 through a data line DL, and a voltage equal to a difference between the voltage of the first node N1 and the data voltage Vdata may be stored in the first capacitor C1.

Here, the reference voltage Ref may be a direct current (DC) voltage having a constant level, and the data voltage Vdata may be a successive voltage that is changed in units of one horizontal period (1H). For example, when an n−1th data voltage Vdata[n−1] is applied to the one end of the first capacitor C1 during one horizontal period, an nth data voltage Vdata[n] is applied to the one end of the first capacitor C1 during the next one horizontal period. In this way, a next voltage may be successively applied to the one end of the first capacitor C1 during each of the next one horizontal periods.

The first transistor T1 may include a gate connected to an nth scan line, a source connected to the first node N1, and a drain connected to a second node N2 corresponding to a drain of the driving transistor Tdr.

A scan signal Scan[n] may be applied to a gate of the first transistor T1. Here, the scan signal Scan[n] may be an nth scan signal applied through an nth scan line among a plurality of scan lines.

Therefore, the operation of the first transistor T1 may be controlled according to the scan signal Scan[n] supplied through a scan line SL. For example, the first transistor T1 is turned on according to the scan signal Scan[n], and connects the first node N1 and the second node N2. When the second transistor T2 is turned on and thus the second node N2 is connected to a third node N3, the voltage at the gate of the driving transistor Tdr corresponding to the first node N1 may be initialized to the voltage of an anode of the OLED.

The second transistor T2 may include a gate connected to an emission control line, a source connected to the second node N2, and a drain connected to the third node N3 corresponding to the anode of the OLED.

The emission control signal Em may be applied to the gate of the second transistor T2.

Therefore, the operation of the second transistor T2 may be controlled according to an emission control signal Em[n] supplied through an emission control line (not shown). For example, the second transistor T2 is turned on according to the emission control signal Em[n], and connects the second node N2 and the third node N3.

The light emission of the OLED may be thereby controlled by the second transistor T2. For example, when the second transistor T2 is turned off and thus the second node N2 is disconnected from the third node N3, the OLED maintains a turn-off state, and when the second transistor T2 is turned on and thus the second node N2 is connected to the third node N3, the OLED emits light.

A control signal C[n] may be applied to one end of the second capacitor C2, and the other end of the second capacitor C2 may be connected to the first node N1 corresponding to the source of the first transistor T1. In this example, the control signal C[n] is a signal to which an n+1th scan signal is inverted. However, a source voltage VDD or VSS instead of the control signal C[n] may be applied to the one end of the second capacitor C2, or another constant voltage may be applied to the one end of the second capacitor C2.

The driving transistor Tdr may include a gate connected to the first node N1, a source connected to a high-level source voltage VDD terminal, and a drain connected to the second node N2.

As noted above, a high-level source voltage VDD may be applied to a source of the driving transistor Tdr. In this example, the drain of the driving transistor Tdr is connected to the drain of the first transistor T1.

For example, when the first transistor T1 is turned off to disconnect the first node N1 from the second node N2, and the second transistor T2 is turned on to connect the second node N2 to the third node N3, the amount of a current flowing in the OLED may be adjusted according to the voltage at the first node N1 corresponding to the gate of the driving transistor Tdr. In this case, the amount of a current flowing in the OLED may be determined by the sum of voltage (Vgs) between the source and gate of the driving transistor Tdr and the threshold voltage (Vth) of the driving transistor Tdr, and may be finally determined by a compensation circuit with the data voltage Vdata and the reference voltage Ref.

Therefore, the amount of a current flowing in the OLED may be proportional to the level of the data voltage Vdata. Accordingly, the OLED display device according to embodiments of the present invention may apply the various levels of data voltage Vdata to respective sub-pixels SP in order to realize different gray scales, thereby displaying an image.

The anode of the OLED may be connected to the third node N3 corresponding to the drain of the second transistor T2, and a low-level source voltage VSS may be applied to a cathode of the OLED.

Hereinafter, the operation of each sub-pixel included in the OLED display device according to embodiments of the present invention will be described in detail with reference to FIGS. 3 and 5A to 5D.

Figure 3:
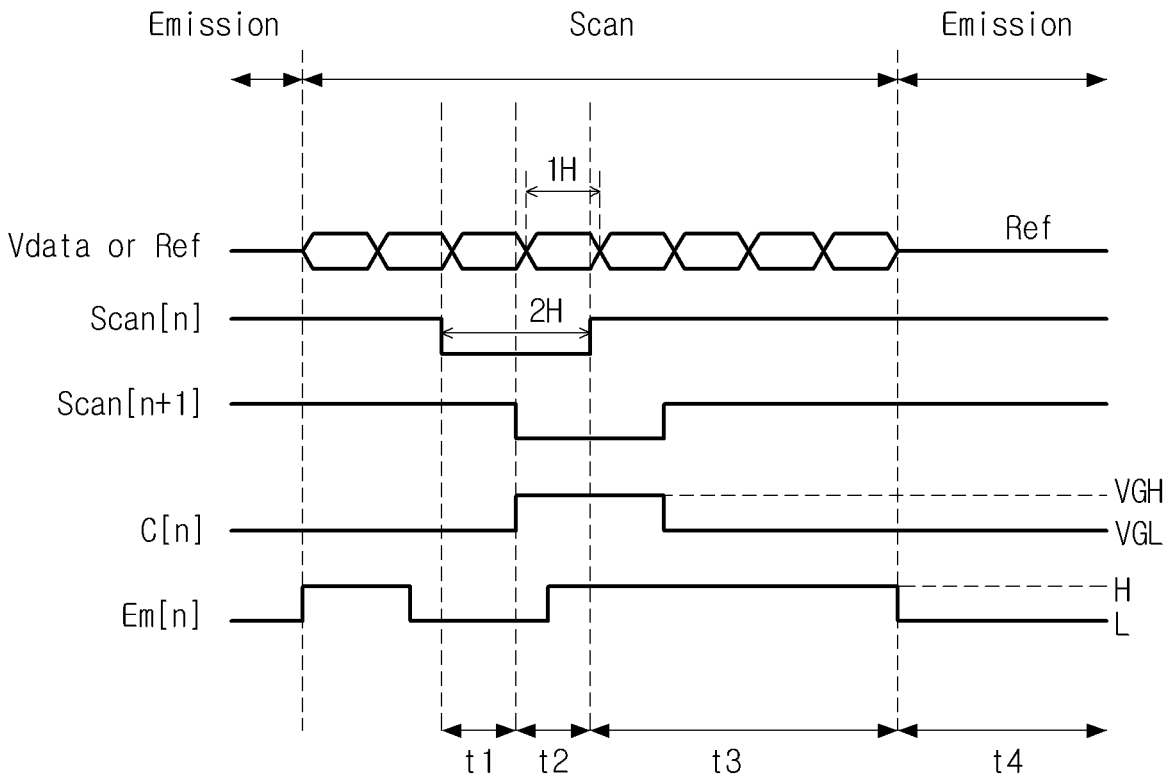
FIG. 3 is a timing chart for control signals supplied to the equivalent circuit of FIG. 2.

FIG. 3 is a timing chart for control signals that may be supplied to the equivalent circuit of FIG. 2. FIGS. 5A to 5D are diagrams for describing a method of driving an OLED display device according to embodiments of the present invention.

As illustrated in FIG. 3, the OLED display device according to embodiments of the present invention may operate during a scan period or an emission period. The scan period may include an initialization period t1, a sampling period t2, and a holding period t3.

First, as shown in FIG. 3, during the initialization period t1, a low-level scan signal Scan[n], a low-level emission control signal Em[n], and a control signal C[n] may be applied to a sub-pixel.

Figure 5A:
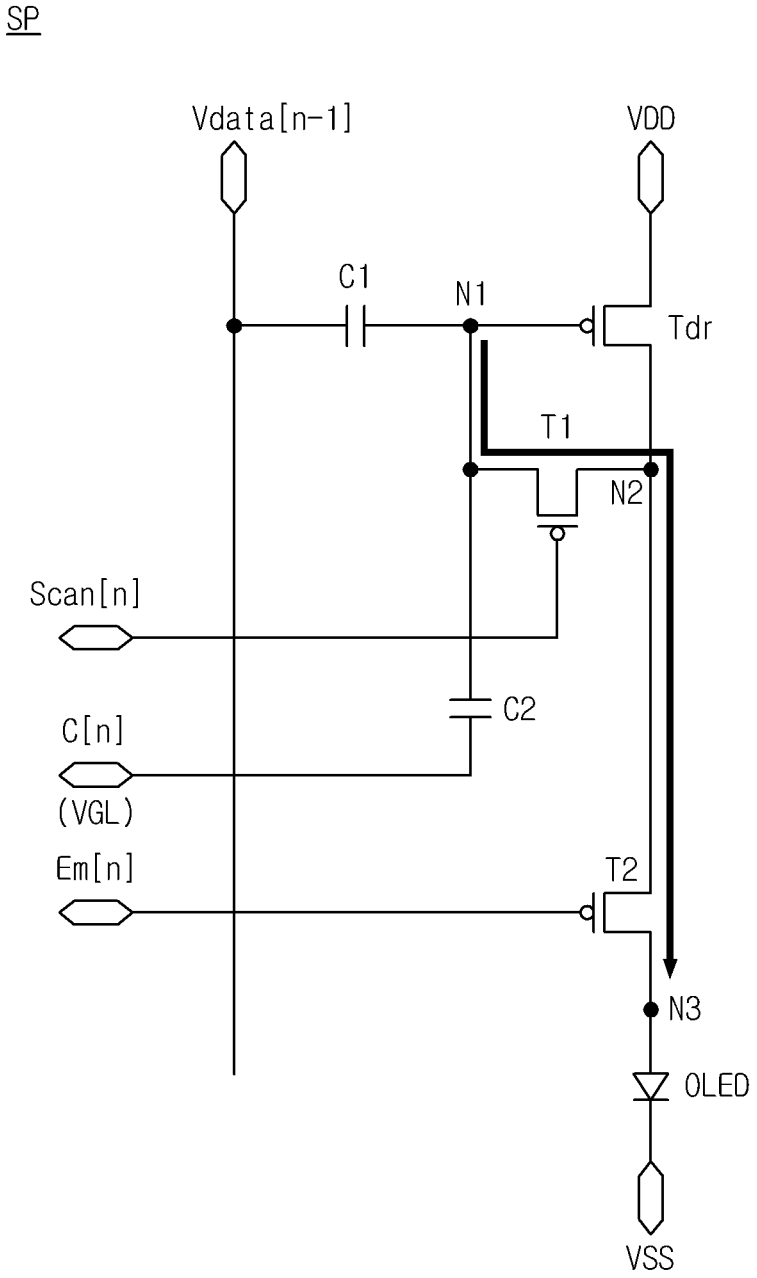
FIGS. 5A to 5D are diagrams for describing an exemplary method of driving an OLED display device according to embodiments of the present invention.

Therefore, as illustrated in FIG. 5A, the first transistor T1 may be turned on with the low-level scan signal Scan[n], and the second transistor T2 may be turned on with the low-level emission control signal Em[n]. Also, an n−1th data voltage Vdata[n−1] may be applied to the one end of the first capacitor C1 through a data line, and a low-level voltage VGL may be applied as the control signal C[n] to the one end of the second capacitor C2.

As a result, during the initialization period t1, the second node N2 is connected to the third node N3, the first node N1 is connected to the second node N2, and thus the first node N1 corresponding to the gate of the driving transistor Tdr is initialized to the voltage of the anode of the OLED corresponding to the voltage of the third node N3.

For example, during the initialization period t1, as the first and second transistors T1 and T2 are turned on, a current path is formed between the first node N1 and a low-level source voltage VSS terminal, and thus the first node N1 is initialized to the voltage of the third node N3 corresponding to the voltage of the anode of the OLED.

Here, during the initialization period t1, the voltage of the anode of the OLED may be lower than a voltage at a time for which a current Ioled flowing in the OLED is peaked. For example, where the anode voltage is 4 V to 5 V at a time for which the current Ioled flowing in the OLED is 1 μA, the voltage of the third node N3 during the initialization period t1 may be initialized to a voltage that is 3 V to 4 V lower than 4 V to 5 V. In this case, although a current does not flow in the OLED, the voltage of the third node N3 may be initialized to the voltage (which is a constant voltage) of the anode of the OLED according to the parasitic capacitance component of the OLED. Also, because the initialization period may be very short, light emitted from the OLED may be invisible to a viewer's eyes.

The above-discussed operation initializes the voltage of the first node N1 to the voltage of the third node N3, due to the n−1th data voltage Vdata[n−1] being applied to the first capacitor C1 included in a sub-pixel connected to the nth scan line because an OLED included in a sub-pixel connected to one scan line emits light with a data voltage corresponding to a corresponding scan line.

Subsequently, as shown in FIG. 3, during the sampling period t2, a low-level scan signal Scan[n], a high-level control signal C[n], and the emission control signal Em[n] may be changed from a low level (L) to a high level (H) and are applied to the sub-pixel.

Figure 5B:
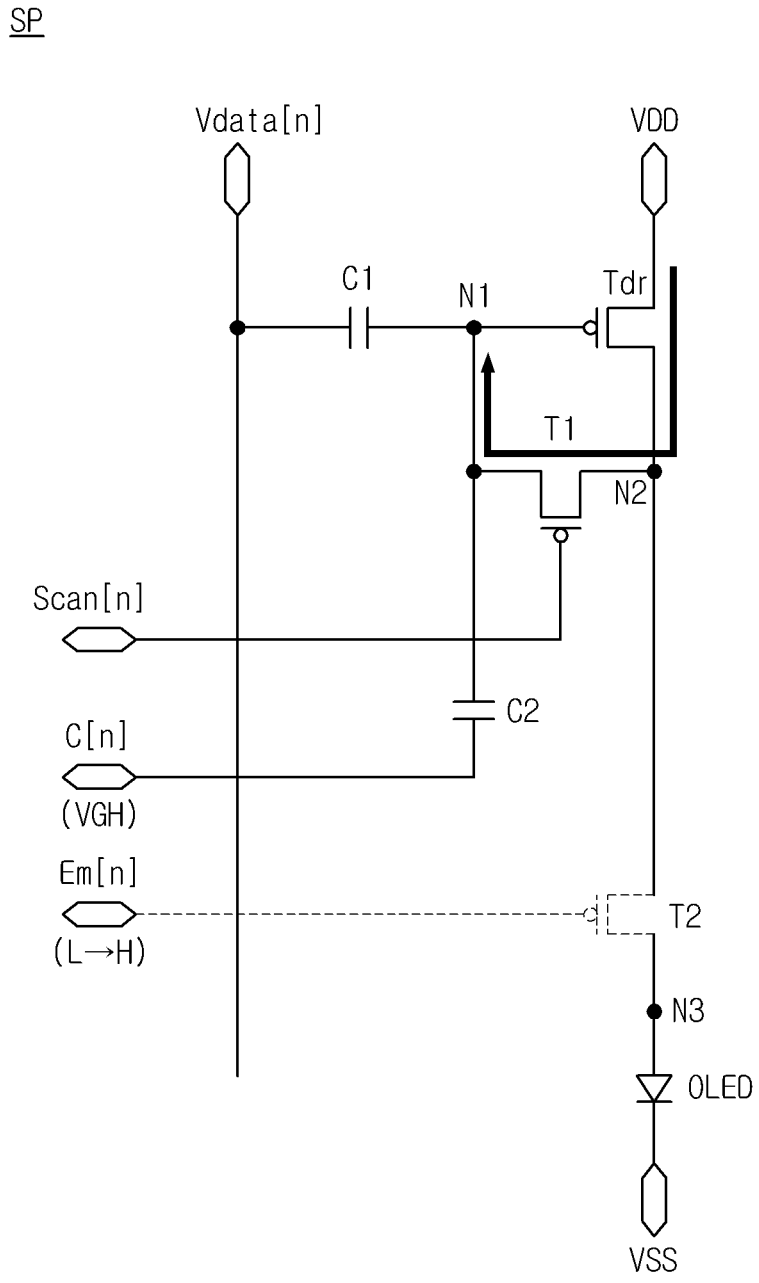

Therefore, as illustrated in FIG. 5B, the first transistor T1 may be turned on with the low-level scan signal Scan[n], and the second transistor T2 having a turn-on state is turned off with the high-level emission control signal Em[n]. Also, the nth data voltage Vdata[n] may be applied to the one end of the first capacitor C1 through a data line, and a high-level voltage VGH may be applied as the control signal C[n] to the one end of the second capacitor C2.

As a result, during the sampling period t2, the first node N1 is connected to the second node N2, and the voltage of the first node N1 corresponding to the gate of the driving transistor Tdr rises to the sum "VDD+Vth" of the high-level source voltage VDD and the threshold voltage (Vth) of the driving transistor Tdr. Also, the nth data voltage Vdata[n] is applied to the one end of the first capacitor C1, and thus the first capacitor C1 is charged with a data voltage equal to a difference of "Vdata[n]−VDD−Vth" between the nth data voltage Vdata[n] and the voltage "VDD+Vth" of the first node N1.

For example, during the sampling period t2, as the first transistor T1 is turned on and the second transistor T2 is turned off, the voltage of the first node N1 may rise to the sum "VDD+Vth" of the high-level source voltage VDD and the threshold voltage (Vth) of the driving transistor Tdr due to the diode connection of the driving transistor Tdr. Therefore, the data voltage equal to the difference of "Vdata[n]−VDD−Vth" between the nth data voltage Vdata[n] and the voltage "VDD+Vth" of the first node N1 may be stored in both ends of the first capacitor C1. As a result, during the sampling period t2, the first capacitor C1 stores the data voltage Vdata[n], and senses the threshold voltage (Vth) of the driving transistor Tdr.

Referring again to FIG. 3, the low-level voltage VGL or the high-level voltage VGH may be applied as the control signal C[n] to the one end of the second capacitor C2 at a time at which the sampling period t2 is first started. At this point, the second transistor T2 is turned on, and thus, even when a voltage applied to the one end of the second capacitor C2 is changed from the low-level voltage VGL to the high-level voltage VGH due to the parasitic capacitance component of the OLED, the voltage of the first node N1 is slightly shaken, but may be maintained as the constant voltage of the anode of the OLED.

Moreover, as shown in FIGS. 3 and 5B, the nth data voltage Vdata[n] may be applied to the one end of the first capacitor C1 before the emission control signal Em[n] is changed from a low level (L) to a high level (H). This is because by applying the nth data voltage Vdata[n] before the second transistor T2 is turned off (even though a data voltage may be applied to the sub-pixel), the voltage of the first node N1 is slightly shaken, but the constant voltage of the anode of the OLED is maintained. In other words, when the data voltage is applied to the sub-pixel after the second transistor T2 is turned off, the voltage of the first node N1 may be largely shaken due to the applied data voltage, and thus the voltage of the first node N1 may increase to higher than the sum "VDD+Vth" of the high-level source voltage VDD and the threshold voltage (Vth) of the driving transistor Tdr during the sampling period t2. To prevent the increase in the voltage of the first node N1, the nth data voltage Vdata[n] may be required to be applied to the one end of the first capacitor C1 before the emission control signal Em[n] is changed from a low level (L) to a high level (H).

Subsequently, as shown in FIG. 3, during the holding period t3, the high-level scan signal Scan[n], the high-level emission control signal Em[n], and the control signal C[n] changed from a high level voltage VGH to a low level voltage VGL may be applied to the sub-pixel.

Figure 5C:
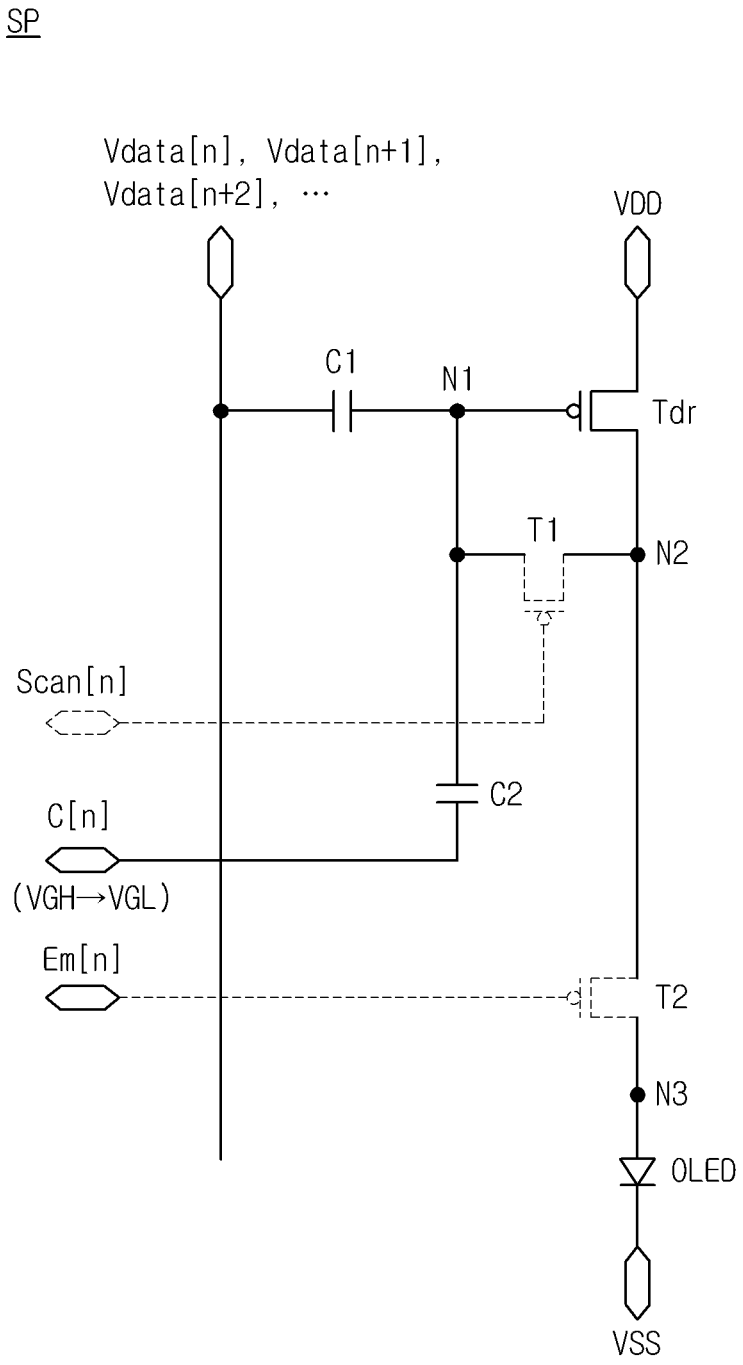

Therefore, as illustrated in FIG. 5C, the first transistor T1 may be turned off with the high-level first scan signal Scan[n], and the second transistor T2 may be turned off with the high-level emission control signal Em[n]. Also, data voltages "Vdata[n+1], Vdata[n+2], . . . " subsequent to the nth data voltage Vdata[n] may be continuously applied to the one end of the first capacitor C1, and, the high-level voltage VGH may be applied as the control signal C[n] to the one end of the second capacitor C2. Then, a voltage changed to the low-level voltage VGL is applied to the one end of the second capacitor C2.

In this example, when the voltage of the one end of the second capacitor C2 is changed from a high-level voltage to a low-level voltage, the voltage of the first node N1 corresponding to the gate of the driving transistor Tdr may be reduced, and thus the current Ioled that flows in the OLED during an emission period t4 may increase to higher than an appropriate current level necessary for the light emission of the OLED.

The OLED display device according to embodiments of the present invention may adjust the capacitance ratio of the first and second capacitors C1 and C2, and thus adjust the current Ioled flowing in the OLED to an appropriate current level. This is because the first and second capacitors C1 and C2 are connected in series, and thus the voltage of the first node N1 may be determined according to a voltage applied to the one end of the first capacitor C1, a voltage applied to the one end of the second capacitor C2, and the capacitance ratio of the capacitors C1 and C2.

Moreover, as shown in FIGS. 3 and 5C, the nth data voltage Vdata[n] may be applied to the one end of the first capacitor C1 until after the scan signal Scan[n] is changed from a low level voltage to a high level voltage. This is because a voltage applied to the one end of the first capacitor C1 may be required to be maintained at the nth data voltage Vdata[n] until before the first transistor T1 is turned off, in order to maintain a constant data voltage stored in the first capacitor C1.

As a result, during the holding period t3, because the second transistor T2 may be maintained in a turn-off state, the OLED may maintain a turn-off state without emitting light, and the first transistor T1 may be turned off, thereby disconnecting the first and second nodes N1 and N2. Also, as the data voltages "Vdata[n+1], Vdata[n+2], . . . " subsequent to the nth data voltage Vdata[n] may be continuously applied to the one end of the first capacitor C1, the voltage of the first node N1 corresponding to the other end of the first capacitor C1 may be continuously changed. However, during the holding period t3, a voltage stored in both ends of the first capacitor C1 may be maintained as a constant voltage equal to the voltage "Vdata[n]−VDD−Vth" that is stored in the first capacitor C1 during the sampling period t2.

The OLED included in the OLED display device according to embodiments of the present invention may not start to emit light after sampling of each scan line is completed for each frame, but may maintain the holding period until samplings of all the scan lines are sequentially completed, and then may start to emit light after the samplings of all the scan lines are completed.

An operation in which all the scan lines are scanned and then all OLEDs emit light at one time will be described below in more detail with reference to FIG. 4.

Figure 4:
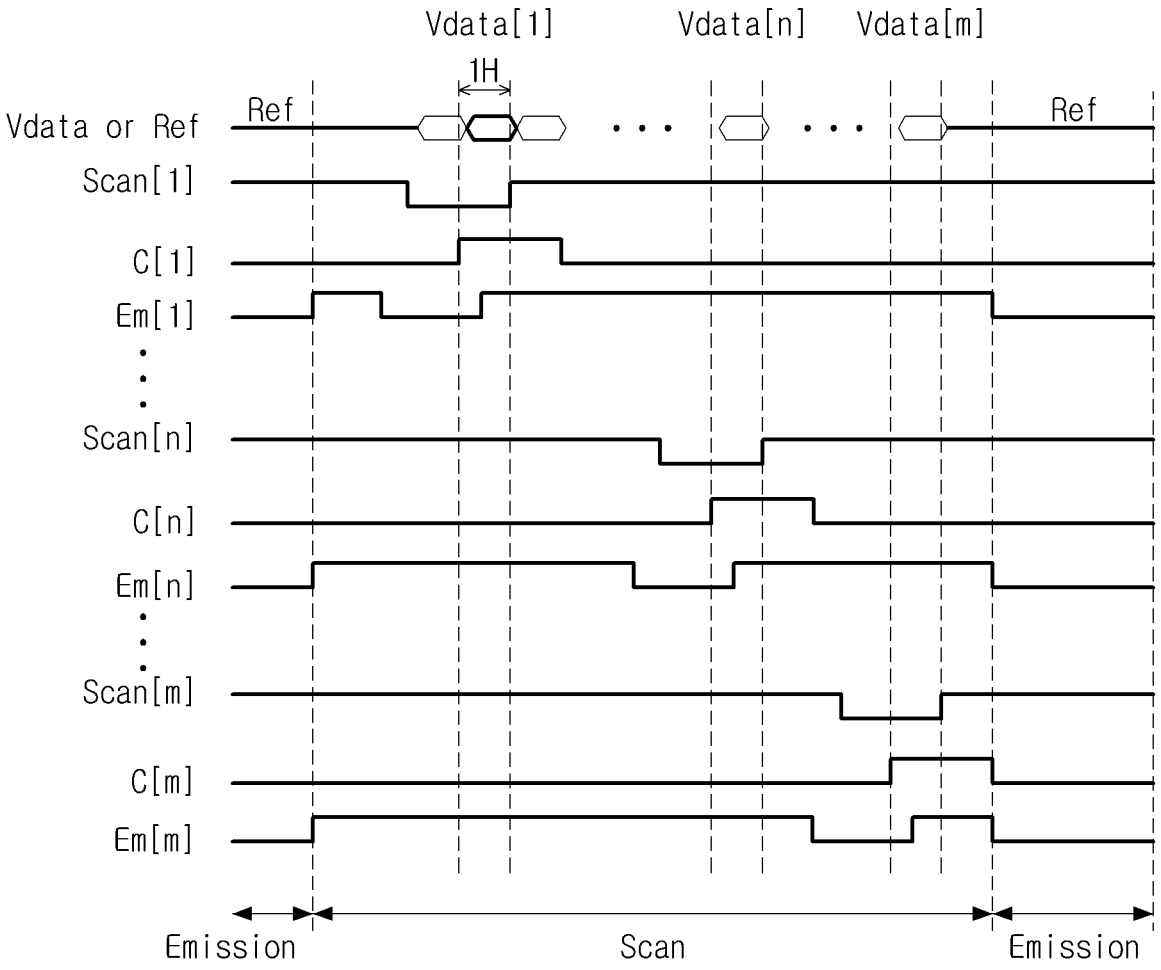
FIG. 4 is a timing chart showing in detail the timing chart of FIG. 3.

FIG. 4 is a timing chart showing in detail the timing chart of FIG. 3. In the OLED display device according to embodiments of the present invention, when it is assumed that there are an 'm' number of scan lines, scan signals Scan[1], Scan[n] and Scan[m] may be respectively applied to a first scan line, an nth scan line, and an mth scan line, and first to mth data voltages Vdata[1] to Vdata[m] may be applied to one data line intersecting each scan line.

Here, a scan period for which a plurality of data voltages are applied to respective sub-pixels may include an initialization period, a sampling period, and a holding period for each scan line.

The holding period may be maintained after sampling of a corresponding data voltage is performed for each scan line, and then, a plurality of second transistors included in the respective sub-pixels may finally be turned on simultaneously with the emission control single Em, whereupon OLEDs respectively connected to the second transistors may start to emit light.

Subsequently, as shown in FIG. 3, during the emission period t4, a high-level scan signal Scan[n], a low-level control signal C[n], and a low-level emission control signal Em[n] may be applied to a sub-pixel.

Figure 5D:
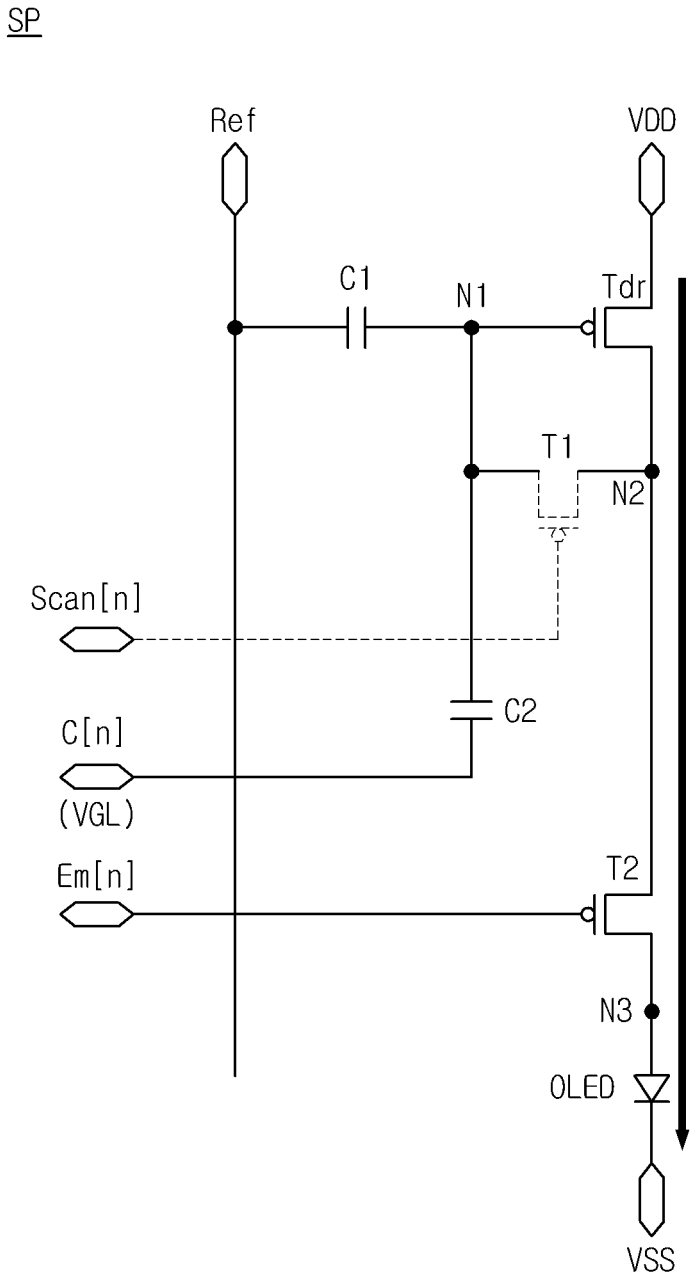

Therefore, as illustrated in FIG. 5D, the first transistor T1 may be maintained in a turn-off state with the high-level scan signal Scan[n], and the second transistor T2 may be turned on with the low-level emission control signal Em[n]. Also, the DC reference voltage Ref may be applied to the one end of the first capacitor C1 through a data line, and the low-level voltage VGL may be applied as the control signal C[n] to the one end of the second capacitor C2.

As a result, during the emission period t4, the first transistor T1 may be turned off to disconnect the first and second nodes N1 and N2, and the second transistor T2 may be turned on to connect the second and third nodes N2 and N3, whereby the OLED may start to emit light.

Accordingly, the current Ioled flowing in the OLED may be determined by a current flowing in the driving transistor Tdr, and the current flowing in the driving transistor Tdr may be determined by a voltage (Vgs) between the gate and source of the driving transistor Tdr and the threshold voltage (Vth) of the driving transistor Tdr. The current Ioled may be defined as expressed in Equation (1). During the emission period t4, as the reference voltage Ref is applied to the one end of the first capacitor C1, the voltage of the first node N1 may be changed. However, a constant voltage stored in both ends of the first capacitor C1 may be maintained, and is determined according to the ratio of a capacitance c1 of the first capacitor C1 and a capacitance c2 of the second capacitor C2. Therefore, the voltage of the gate of the driving transistor Tdr corresponding to the first node N1 may be "{c1/(c1+c2)}(Ref−Vdata[n])+{c2/(c1+c2)}(VGL−VGH)+VDD+Vth".

$$\begin{aligned} Ioled &= K \times (Vgs - Vth)^2 \qquad (1) \\ &= K \times (Vgs + Vth)^2 \\ &= K \times \begin{bmatrix} VDD - \{c1/(c1+c2)\}(Ref - Vdata[n]) - \\ \{c2/(c1+c2)\}(VGL - VGH) - VDD - Vth + Vth \end{bmatrix}^2 \\ &= K \times [\{c1/(c1+c2)\}(Vdata[n] - Ref) - a]^2 \end{aligned}$$

where K denotes a proportional constant that is determined by the structure and physical properties of the driving transistor Tdr, and may be determined with the mobility of the driving transistor Tdr and the ratio "W/L" of the channel width "W" and length "L" of the driving transistor Tdr. Also, a may be a voltage "{c2/(c1+c2)}(VGL−VGH)" with consideration of the change (which is caused by a voltage applied to the one end of the second capacitor C1) in the voltage of the first node N1, and the influence of a can be minimized by adjusting the capacitance ratio of the first and second capacitors C1 and C2. The threshold voltage "Vth" of the driving transistor Tdr may not always have a constant value, and the deviation of the threshold voltage "Vth" may occur according to the operational state of the driving transistor Tdr.

Referring to Equation (1), in the OLED display device according to embodiments of the present invention, the current Ioled flowing in the OLED may not be affected by the threshold voltage "Vth" and the source voltages VSS and VDD during the emission time t4, and may be determined by a difference between the data voltage Vdata and the reference voltage Ref.

Accordingly, the OLED display device may compensate for the deviation of each of the threshold voltage, high-level source voltage, and low-level source voltage due to the operational state of the driving transistor, and thus may maintain a constant current flowing in the OLED, thereby preventing the degradation of image quality.

Moreover, in the OLED display device according to embodiments of the present invention, the number of transistors included in the compensation circuit may be reduced, and, the OLED display device may not apply a constant voltage to the second capacitor through a separate line but may apply a scan signal to the second capacitor. Accordingly, embodiments of the present invention can decrease the layout area of the panel without designing the separate line, and thus, the OLED display device according to embodiments of the present invention may be suitable for high resolution.

In the OLED display device according to embodiments of the present invention, as expressed in Equation (1), the current Ioled flowing in the OLED may be determined according to the ratio of the capacitance c1 of the first capacitor C1 and the capacitance c2 of the second capacitor C2.

This is because the first and second capacitors C1 and C2 are connected in series during the holding period t3 and the emission period t4.

In another embodiment, when the second capacitor C2 is not connected to the first node N1 but is connected to the second node N2, the ratio of the capacitance c1 of the first capacitor C1 and the capacitance c2 of the second capacitor C2 may not affect the current Ioled flowing in the OLED.

Therefore, when the ratio of the capacitance c1 of the first capacitor C1 and the capacitance c2 of the second capacitor C2 affects the current Ioled flowing in the OLED, the current Ioled flows in the OLED under the same data voltage regardless of whether the current Ioled is low. In other words, when the ratio of the capacitance c1 of the first capacitor C1 and the capacitance c2 of the second capacitor C2 affects the current Ioled flowing in the OLED, a case in which the current Ioled flowing in the OLED at its peak requires a higher voltage than a case in which the current Ioled flowing in the OLED is not at its peak, and thus, the resolving power of the current Ioled that flows in the OLED with a particular data voltage can be enhanced.

Hereinafter, the resolving power of the current Ioled flowing in the OLED will be described with reference to FIG. 6.

Figure 6:
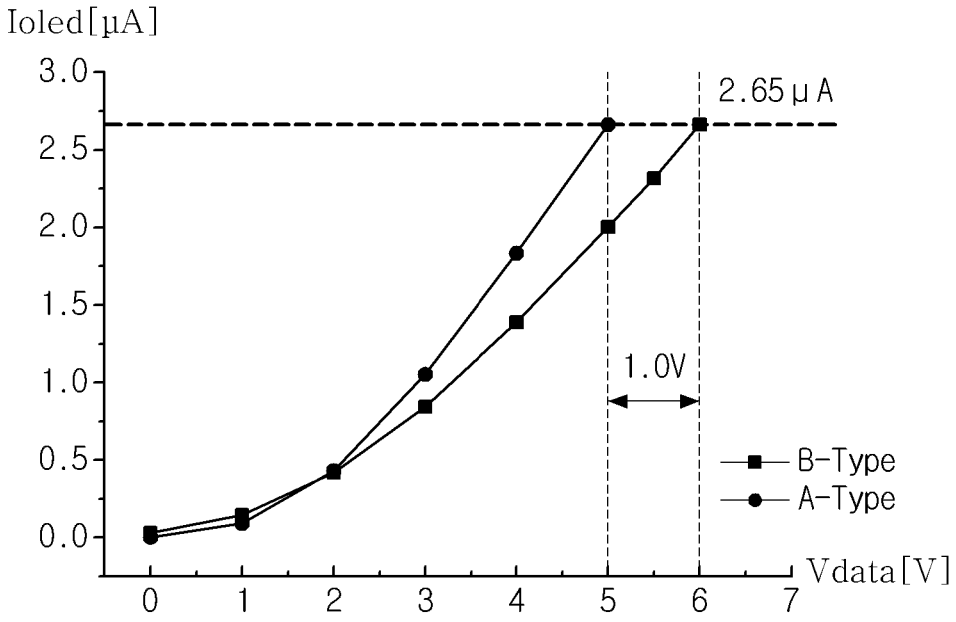
FIG. 6 is a diagram for describing the current resolving power of an OLED display device according to embodiments of the present invention.

FIG. 6 is a diagram for describing the current resolving power of an OLED display device according to embodiments of the present invention.

In an A-type circuit, it is assumed that the second capacitor C2 is connected to the second node N2 instead of the first node N1, and thus, the capacitance ratio of the first and second capacitors C1 and C2 does not affect the current Ioled flowing in the OLED. In a B-type circuit, it is assumed that the second capacitor C2 is connected to the first node N1, and thus, the capacitance ratio of the first and second capacitors C1 and C2 affects the current Ioled flowing in the OLED.

As shown in FIG. 6, when the peak of the current Ioled flowing in the OLED is 2.65 μA, the A-type circuit uses a data voltage of 5 V, but the B-type circuit uses a data voltage of 6 V. Therefore, it can be seen that the current resolving power of the B-type circuit is enhanced by 1 V compared to the A-type circuit.

Accordingly, in the OLED display device according to an embodiment of the present invention, the current resolving power can be enhanced by the serial connection between the first and second capacitors C1 and C2.

The above description has indicated that the current Ioled flowing in the OLED is not affected by the threshold voltage (Vth) of the driving transistor Tdr, the high-level source voltage VDD, and the low-level source voltage VSS. This will be described in detail with reference to FIGS. 7 to 9.

Figure 7:
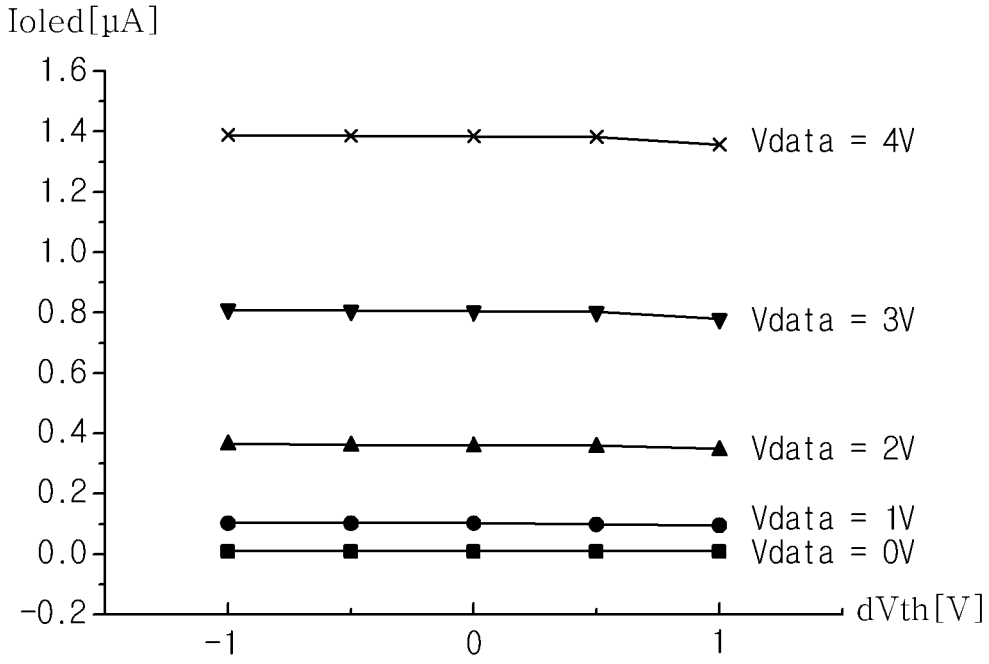
FIGS. 7 to 9 are diagrams for describing the change in a current due to the threshold voltage deviation, high-level source voltage, and low-level source voltage of an OLED display device according to embodiments of the present invention.
Figure 8:
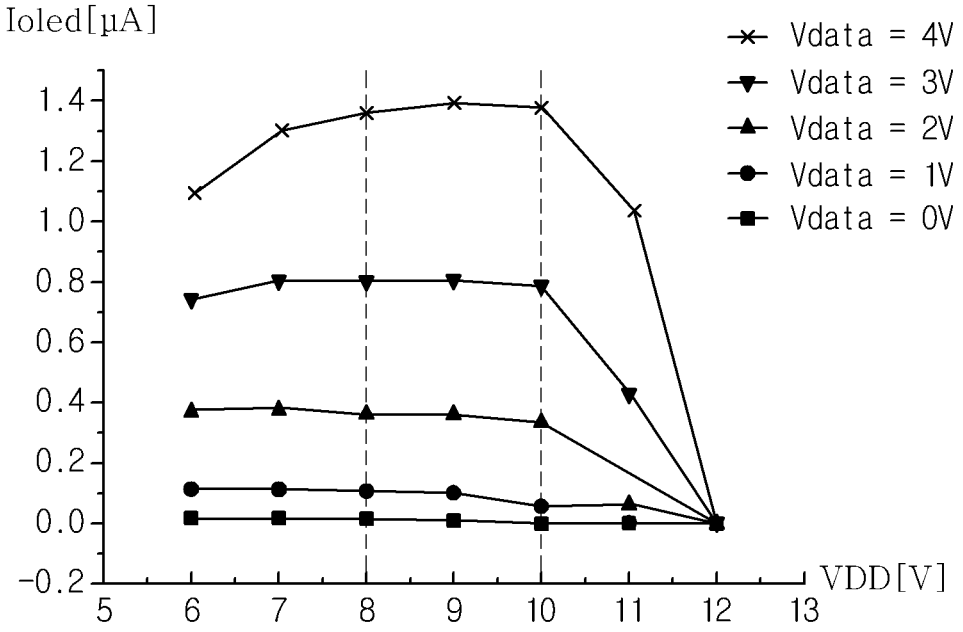
Figure 9:
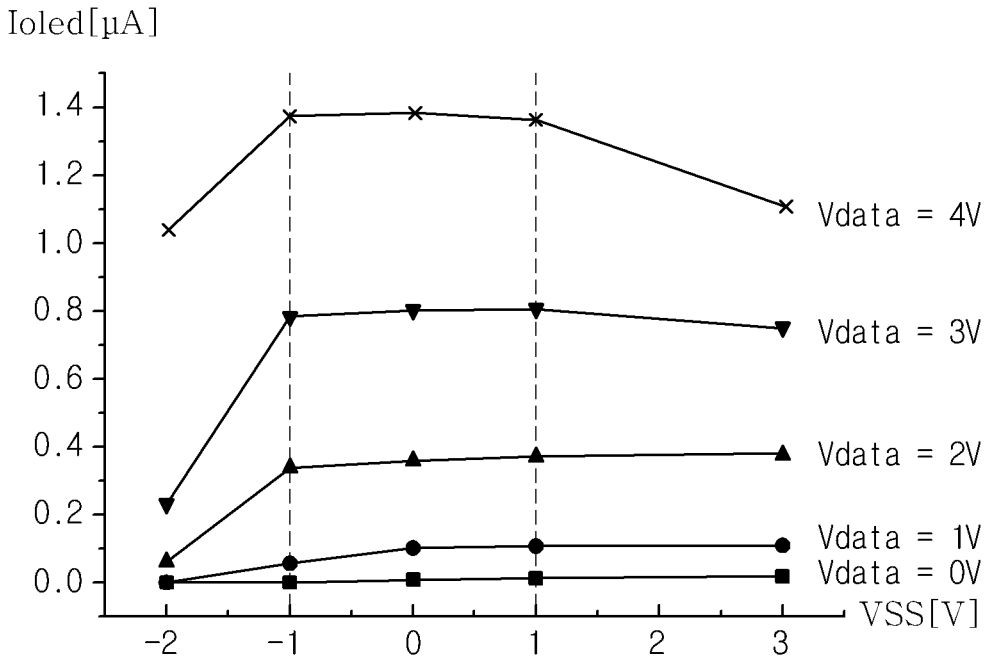

FIGS. 7 to 9 are diagrams for describing the change in a current due to the threshold voltage deviation, high-level source voltage, and low-level source voltage of an OLED display device according to embodiments of the present invention.

As shown in FIG. 7, it can be seen that the level of the current Ioled flowing in the OLED may be proportional to the data voltage Vdata, but the constant level of the current Ioled may be maintained under the same data voltage Vdata regardless of the deviation (dVth) of the threshold voltage (Vth).

Moreover, as shown in FIG. 8, it can be seen that the level of the current Ioled flowing in the OLED may be proportional to the data voltage Vdata similar to FIG. 7, but the constant level of the current Ioled may be maintained under the same data voltage Vdata (for example, within a range of 8 V to 10 V) regardless of the high-level source voltage VDD. Accordingly, it can be seen that when the high-level source voltage VDD for the OLED display device according to various embodiments of the present invention is 9 V, the deviation of the high-level source voltage VDD can be compensated for within a range of −1 V to 1 V.

Moreover, as shown in FIG. 9, it can be seen that the level of the current Ioled flowing in the OLED is proportional to the data voltage Vdata similar to FIG. 7, but the constant level of the current Ioled may be maintained under the same data voltage Vdata (for example, within a range of −1 V to 1 V) regardless of the low-level source voltage VSS. Accordingly, it can be seen that when the low-level source voltage VSS for the OLED display device according to various embodiments of the present invention is 0 V, the deviation of the high-level source voltage VDD can be compensated for within a range of −1 V to 1 V.

According to embodiments of the present invention, the OLED display device compensates for the deviation of each of the threshold voltage, high-level source voltage, and low-level source voltage due to the operational state of the driving transistor, and thus may maintain a constant current flowing in the OLED, thereby preventing the degradation of image quality.

Moreover, according to the embodiments of the present invention, the number of transistors included in the compensation circuit may be reduced, and the OLED display device may not apply a constant voltage to the second capacitor through a separate line but may apply a control signal (which may be a scan signal) to the second capacitor. Accordingly, embodiments of the present invention can decrease the layout area of the panel to be suitable for high resolution without designing the separate line.

It will be apparent to those skilled in the art that various modifications and variations can be made in embodiments of the present invention without departing from the spirit or scope of the invention. Thus, it is intended that the present invention covers the modifications and variations of this invention provided they come within the scope of the appended claims and their equivalents.

What is claimed is:

1. An organic light emitting diode (OLED) display device, comprising:

a first capacitor connected between a data line and a first node, and receiving a data voltage or a reference voltage that is supplied through the data line;

a first transistor connected to the first node and a second node, and connecting the first and second nodes according to a scan signal;

an OLED connected between a low-level voltage source terminal and a third node;

a second transistor connected to the second and third nodes, and configured to control light emission of the OLED;

a driving transistor having a gate connected to the first node, a drain connected to the second node, and a source connected to a high-level voltage source terminal; and a second capacitor, one end of the second capacitor configured to receive a control signal, and the other end of the second capacitor being connected to the first node, wherein the scan signal is an nth scan signal and the control signal is an inverted n+1th scan signal.

2. The OLED display device of claim 1, wherein a gate of the second transistor is connected to an emission control line, whereby the light emission of the OLED is controlled by an emission control signal through the emission control line.

3. The OLED display device of claim 1, wherein the data voltage is continuously supplied through the data line and is changed in units of one horizontal period.

4. The OLED display device of claim 1, wherein the reference voltage is a direct current (DC) voltage having a constant level.

5. The OLED display device of claim 1, wherein when the first transistor is turned on by the scan signal and the second transistor is turned on by an emission control signal, a voltage at the gate of the driving transistor is initialized to a voltage at the third node, the third node corresponding to an anode of the OLED.

6. The OLED display device of claim 5, wherein the data voltage includes a plurality of successive data voltages, and when the first transistor is turned on by the scan signal and the second transistor is turned on by the emission control signal, an n−1th data voltage of the plurality of successive data voltages is supplied to the first capacitor.

7. The OLED display device of claim 1, wherein the data voltage includes a plurality of successive data voltages, and when the first transistor is turned on by the scan signal and the second transistor is turned off by an emission control signal, an nth data voltage of the plurality of successive data voltages is supplied to the first capacitor, and a high-level voltage is supplied as the control signal to the second capacitor, the first capacitor stores the nth data voltage and senses the threshold voltage of the driving transistor.

8. The OLED display device of claim 1, wherein the data voltage includes a plurality of successive data voltages, and when the first transistor is turned off by the scan signal and the second transistor is turned off by an emission control signal, data voltages of the successive data voltages subsequent to an nth data voltage of the plurality of data voltages are applied to the first capacitor, and a high-level voltage changed to a low-level voltage is supplied as the control signal to the second capacitor.

9. The OLED display device of claim 1, wherein the data voltage includes a plurality of successive data voltages, and when the first transistor is turned off by the scan signal and the second transistor is turned on by an emission control signal, the reference voltage is supplied to the first capacitor, and a low-level voltage is supplied as the control signal to the second capacitor, the reference voltage being a direct current (DC) voltage.

10. The OLED display device of claim 1, wherein the second transistor is directly connected to the second and third nodes.

11. A method of driving an organic light emitting diode (OLED) display device which includes first and second transistors, a driving transistor, first and second capacitors, and an OLED, the method comprising:

performing an operation in which while the first and second transistors are turned on, a first node corresponding to a gate of the driving transistor is connected to a second node corresponding to a drain of the driving transistor, a third node corresponding to an anode of the OLED is connected to the second node, and a control signal is applied as a low-level voltage to one end of the second capacitor connected to the first node;

performing an operation in which while the first transistor is turned on and the second transistor is turned off, an nth data voltage is applied to one end of the first capacitor, a voltage of the first node corresponding to the other end of the first capacitor increases to a sum of a high-level source voltage and a threshold voltage of the driving transistor, and the control signal is applied to as a high-level voltage to the one end of the second capacitor;

performing an operation in which while the first and second transistors are turned off, data voltages after the nth data voltage are continuously applied to one end of the first capacitor, and the control signal is changed from the high-level voltage to the low-level voltage; and performing an operation in which while the first transistor is turned off and the second transistor is turned on, a reference voltage is applied to the one end of the first capacitor, and the OLED emits light.

12. The method according to claim 11, wherein performing the operation while in which the first and second transistors are turned on further includes applying an n−1th data voltage to the one end of the first capacitor.

13. The method according to claim 11, wherein performing the operation while in which the first and second transistors are turned off further includes applying the high-level voltage that changes to the low-level voltage to the one end of the second capacitor via the control signal.

14. The method according to claim 11, wherein performing the operation while in which the first transistor is turned off and the second transistor is turned on further includes applying a low-level voltage to the one end of the second capacitor via the control signal.

15. The method according to claim 14, wherein the reference voltage is a direct current (DC) voltage.

16. The method according to claim 11, wherein the organic light emitting diode display device includes:

the first capacitor connected between a data line and the first node, and receiving the data voltage or the reference voltage that is supplied through the data line;

the first transistor connected to the first node and the second node, and connecting the first and second nodes according to a scan signal;

the OLED connected between a low-level voltage source terminal and the third node;

the second transistor connected to the second and third nodes, and configured to control light emission of the OLED;

the driving transistor having the gate connected to the first node, the drain connected to the second node, and a source connected to a high-level voltage source terminal; and the second capacitor, one end of the second capacitor configured to receive a control signal, and the other end of the second capacitor being connected to the first node.

* * * * *